US007029733B2

(12) United States Patent
Gration et al.

(10) Patent No.: US 7,029,733 B2
(45) Date of Patent: Apr. 18, 2006

(54) PRINTED MATTER PRODUCING REFLECTIVE INTAGLIO EFFECT

(75) Inventors: Ronald Gibson Gration, East Doncaster (AU); Ana Ghioghiu, Elsternwick (AU); Cameron Rex Hibbert, Churchill (AU); Paul Zientek, North Carlton (AU)

(73) Assignee: Securency Pty Ltd, Craigieburn (AU)

( * ) Notice: Subject to any disclaimer, the term of this patent is extended or adjusted under 35 U.S.C. 154(b) by 269 days.

(21) Appl. No.: 09/355,169

(22) PCT Filed: Jan. 29, 1998

(86) PCT No.: PCT/AU98/00046

§ 371 (c)(1),
(2), (4) Date: Aug. 30, 1999

(87) PCT Pub. No.: WO98/33658

PCT Pub. Date: Aug. 6, 1998

(65) Prior Publication Data

US 2003/0003275 A1 Jan. 2, 2003

(30) Foreign Application Priority Data

Jan. 29, 1997 (AU) ..... PO 4847

(51) Int. Cl.
*B44F 1/10* (2006.01)

(52) U.S. Cl. ..... 428/29; 428/195; 428/212; 428/537.5; 428/916

(58) Field of Classification Search ..... 428/29, 428/195, 212, 537.5, 916
See application file for complete search history.

(56) References Cited

U.S. PATENT DOCUMENTS

| | | | | | |
|---|---|---|---|---|---|
| 4,033,059 | A | * | 7/1977 | Hutton et al. | 40/137 |
| 4,066,280 | A | | 1/1978 | LaCapria | |
| 4,124,947 | A | * | 11/1978 | Kuhl et al. | 40/453 |
| 4,215,170 | A | * | 7/1980 | Vilaprinyo Oliva | 428/328 |
| 4,420,515 | A | | 12/1983 | Amon et al. | |
| 4,434,259 | A | * | 2/1984 | Gold et al. | 524/31 |
| 4,567,098 | A | * | 1/1986 | Becker et al. | 428/327 |
| 4,588,212 | A | | 5/1986 | Castagnoli | |
| 4,715,623 | A | | 12/1987 | Roule et al. | |
| 5,393,099 | A | * | 2/1995 | D'Amato | 283/91 |
| 5,413,839 | A | | 5/1995 | Chatwin et al. | |
| 5,464,681 | A | * | 11/1995 | Luce | 428/195 |
| 5,569,512 | A | * | 10/1996 | Brawner et al. | 428/29 |
| 5,653,792 | A | | 8/1997 | Phillips et al. | |
| 5,722,693 | A | | 3/1998 | Wicker | |
| 5,735,547 | A | | 4/1998 | Morelle et al. | |
| 5,915,731 | A | | 6/1999 | Jackson | |
| 5,964,936 | A | | 10/1999 | Reisser | |
| 6,036,233 | A | | 3/2000 | Braun et al. | |
| 6,089,546 | A | | 7/2000 | Griffioen et al. | |

FOREIGN PATENT DOCUMENTS

| | | |
|---|---|---|
| AU | 488652 | 4/1976 |
| EP | 0 093 009 A2 | 11/1983 |
| EP | 0 176 702 A1 | 4/1986 |
| GB | 2065560 A | 7/1981 |
| GB | 2 231 572 A | 11/1990 |
| WO | 83/00659 | 3/1983 |
| WO | WO 90/02658 | 3/1990 |
| WO | 93/22146 | 11/1993 |
| WO | WO 93/22146 | 11/1993 |
| WO | WO 96/07547 | 3/1996 |

OTHER PUBLICATIONS

"Intaglio Over Foil," Sales Brochure from Thomas De La Rue Limited, Hampshire, England.

* cited by examiner

*Primary Examiner*—Cynthia H. Kelly
*Assistant Examiner*—B. Shewareged
(74) *Attorney, Agent, or Firm*—Christensen O'Connor Johnson Kindness PLLC

(57) ABSTRACT

A printed document or other device comprising a polymer substrate having a surface to which printed matter is applied, a reflective or brightly colored layer applied directly to said surface by means of a printing process, and a printed image applied to the reflective or brightly colored layer by an intaglio printing process.

21 Claims, No Drawings

PRINTED MATTER PRODUCING REFLECTIVE INTAGLIO EFFECT

This is a United States national stage application of International application No. PCT/AU98/00046, filed Jan. 29, 1998, the benefit of the filing date of which is hereby claimed under 35 U.S.C. §120, which in turn claims the benefit of Australian Application No. PG 4847, filed Jan. 29, 1997, the benefit of the filing date of which is hereby claimed under 35 U.S.C. §119.

FIELD OF THE INVENTION

This invention relates to printed matter, including banknotes, security documents and devices, and all other printed matter.

BACKGROUND OF THE INVENTION

The printing industry is constantly looking for printing techniques which produce printed matter which offers additional security or which is visually appealing in various applications.

In the security printing industry, printed matter which exhibits an effect when visually inspected under various light conditions, but which is not capable of replication using known duplicating methods, such as photocopying or scanning, is highly advantageous.

A security document having some of these features is disclosed in U.S. Pat. No. 4,420,515—Amon et al, which includes a metallic film which is printed or embossed to produce a latent image which is viewed to verify the authenticity of the document. However, the process by which this document is produced requires a number of complex steps to apply the metallic film to the substrate before printing and embossing, and since it would be impractical to incorporate these application steps in the usual document printing process, difficulties will be experienced in making the process commercially attractive. Furthermore, the image produced by the printing and embossing of the metallic film is a latent image which may require specific conditions for viewing and verification.

The introduction of banknotes printed on polymer substrates has introduced a further dimension to the security printing industry, and the present invention seeks to provide a further improvement in banknotes and other security devices exhibiting the abovementioned desirable effect.

SUMMARY OF THE INVENTION

The invention provides a printed document or other device comprising a substrate having a surface to which printed matter is applied, a reflective or brightly coloured layer applied directly to said surface as part of a printing process without embossing the layer, and a raised printed image applied to said reflective or brightly coloured layer by a printing process, at least part of said raised printed image having a height of at least 5 μm and being visible from all angles of the document, said raised printed image being enhanced by said reflective or brightly coloured layer when viewed at different angles and under different lighting conditions.

By applying a raised printed image on a reflective or brightly coloured layer, the colour of the printed image is intensified and becomes brighter and is thus enhanced, and an optically variable image is produced when the document is viewed under different lighting conditions or at different viewing angles thereby introducing an optically variable effect of benefit in security applications. Since the reflective or brightly coloured layer is printed on said substrate, or is applied as part of a printing process, it is conveniently incorporated into the printing process to overcome the production shortcomings of the process described in U.S. Pat. No. 4,420,515. Furthermore, the effect of the reflective or brightly coloured layer is to enhance the visible image produced by the raised printed regions, rather than to produce a latent image as in the U.S. Patent. The enhanced image is able to be directly viewed and does not require special lighting or other conditions.

The raised printed image is most conveniently produced by an intaglio printing process, although acceptable raised images may be produced by other known printing processes or by a combination of embossing and printing on raised embossed surfaces.

The enhanced image effect referred to above is not achieved if the image is printed using the normal offset printing process, and unless the height of the raised print is at least 5 μm, the enhancement produced by the underlying reflective or brightly coloured layer may be insufficient.

In one form of the invention, the substrate is a polymer film and preferably a laminated film of the type used in the production of Australian banknotes. Alternatively, the substrate can be a paper substrate provided it has a smooth surface on which the reflective or brightly coloured layer is applied.

In certain applications or areas of the document, the reflective or brightly coloured layer can be applied directly to the substrate or film, which can have its own reflective effect, thereby intensifying the reflective properties of the reflective or brightly coloured layer. In other applications, an opaque ink layer may be first applied to the surface of the substrate and the reflective or brightly coloured layer applied to the opaque layer.

Both the reflective or brightly coloured layer and the opaque layer are preferably applied to the substrate by the Gravure printing process, although the reflective or brightly coloured layer may comprise a metallised foil or a brightly coloured foil which is laminated or adhesively applied to the surface of the substrate as part of the printing process.

The invention also provides a method of producing a printed document or other device on a substrate, comprising the step of applying a reflective or brightly coloured layer directly to the substrate as part of a printing process, followed by the step of applying a raised image to the reflective or brightly coloured layer by a printing process so that at least part of said raised image has a height of at least 5μ and is visible from all angles of the document.

In one form of the invention, the reflective or brightly coloured layer is an ink layer applied by the Gravure printing process and the raised print is produced by an intaglio printing process. Alternatively, the reflective or brightly coloured layer comprises a reflective or brightly coloured foil which is laminated or adhesively applied to the surface of the substrate as part of the printing process.

In a particularly preferred form of the invention, the reflective or brightly coloured layer is applied to an opaque layer which has been applied to the substrate.

DESCRIPTION OF PREFERRED EMBODIMENT

In a presently preferred form of the invention, a thin polymer substrate comprising laminated polypropylene sheets of the type currently used to produce Australian polymer banknotes firstly has an opaque layer applied to both sides of the substrate by the Gravure printing process, following which a reflective or brightly coloured layer of ink is applied also by the Gravure process.

The ink can comprise any suitable ink which produces a reflective or brightly coloured effect. Suitable inks include the following pigments blended at a 30% to 70% w/w concentration in clear varnish suitable for Gravure application.

Product Description: Flake oxidation resistant metal powder based on a copper-zinc-alloy. (ca 85% Cu, 15% Zn)
Particle Size: <45 μm
Product Manufacturer: ECKART-WERKE GmbH & Co and
Product Name: Aluminium Powder Super Lining GGT
Product Description: Aluminium Powder (Aluminium based on H-A199,5%)
Manufacturer as above.

Printed matter is then applied to the surface of the reflective or brightly coloured layer by the intaglio process to produce a print having raised regions having a height of at least 5 μm. The maximum height of the raised region will be determined by the intaglio or other printing/embossing process, but enhanced effects have been observed with raised regions of about 50 μm in height. In the present example, the intaglio print can comprise the same prints which are currently applied to Australian polymer banknotes, and these prints are significantly enhanced by the reflective or brightly coloured background and an optically variable image is produced when the intaglio print is viewed under different lighting conditions and viewing angles.

Most printed images will have regions in which substantially parallel lines of raised ink are present. When these lines are viewed at an angle other than directly above the lines, significant enhancement of the image is produced by the reflective or brightly coloured layer. Of course, even if there are no parallel lines, some enhancement of the image is still produced by the underlying reflective or brightly coloured layer.

The reflective effect of the reflective or brightly coloured layer complements the image applied by the intaglio process since the intaglio process transfers a raised print to the substrate, and when such a print is applied to the reflective surface, a novel effect is achieved. An image can be observed by viewing the intaglio image at different angles. If the same intaglio image is printed on a nonreflective substrate, the same effect will not be achieved. The novel image effect may be explained by the following factors:

When the raised intaglio print is viewed at a specific angle the walls of the intaglio lines hide the background print. The reflective or brightly coloured nature of the substrate intensifies the distinction between the intaglio and reflective substrate revealing and enhancing the raised image.

The flat/smooth nature of polymer substrate enhanced by a reflective or brightly coloured printed surface, in addition to the raised surface of the intaglio image intensifies both of these properties.

As mentioned above, the reflective or brightly coloured ink can be applied directly to the surface of the polymer substrate since the substrate has its own reflective effect, and this intensifies the reflective effect produced by the reflective or brightly coloured ink layer. If the reflective or brightly coloured ink is applied without an opaque layer, the image will still provide a beneficial effect. Alternatively, if the reflective or brightly coloured ink layer is applied in a region which has been printed on the other side, the printed image will still be enhanced by the underlying reflective layer.

As mentioned above, the reflective ink layer can be replaced by a reflective foil or other film which is laminated or adhesively applied to the substrate and a similar effect is achieved in either case. Suitable reflective foils include those that are applied onto the substrate by hot stamping techniques. These foils typically comprise of a carrier film, a release layer, a metallised layer and an adhesive. Application of the foils is achieved by the hot stamping technique where the foil is adhered onto the substrate at a temperature of, but not limited to, 130° C. and high compressive pressure, so that the adhesive is activated and the carrier film is released.

By applying an intaglio print to a reflective or brightly coloured substrate, the security features of the intaglio image are substantially enhanced, resulting in greater distinction of a security image. Both the optically variable intaglio effect and the reflective/glossy nature of the substrate are difficult to replicate by standard duplicating methods, such as colour photocopying or scanning, and the effect produced is aesthetically pleasing.

What is claimed is:

1. A printed document or other device comprising a substrate to which printed matter is applied, wherein said substrate is a plastics film capable of use to form a banknote, said substrate having a first side and a second side, a reflective or brightly coloured print layer which is printed onto one side of the substrate without embossment, said reflective or brightly coloured print layer being printed over an opaque ink layer applied to one side of said substrate, and a raised print image printed to said reflective or brightly coloured layer by a printing process, at least part of said raised print image having a height of at least 5 μm and being visible from all angles of the document, said raised print image being enhanced by said reflective or brightly coloured print layer when viewed at different angles and under different lighting conditions.

2. The document of claim 1, wherein the raised print image is produced by an intaglio printing process.

3. The document of claim 1, wherein the reflective or brightly coloured layer and the opaque layer are applied to the substrate by a Gravure printing process.

4. The document as claimed in claim 1, wherein said raised print image is a pattern having regions of substantially parallel lines.

5. The document as claimed in claim 2, wherein said raised printed image is a pattern having regions of substantially parallel lines.

6. A printed document or other device comprising a substrate to which printed matter is applied, said substrate having a first side and a second side, a reflective or brightly coloured print layer which is printed onto one side of the substrate without embossment wherein the reflective or brightly coloured print layer is a reflective or brightly colored ink layer, and a raised print image printed to said reflective or brightly coloured print layer by a printing process, at least part of said raised print image having a height of at least 5 μm and being visible from all angles of the document, said raised print image being enhanced by said reflective or brightly coloured print layer when viewed at different angles and under different lighting conditions.

7. The printed document or other device as claimed in claim 6, wherein the reflective or brightly coloured layer is printed over an opaque ink layer applied to one side of the substrate.

8. The printed document or other device as claimed in claim 6, wherein the raised image is produced by an intaglio printing process.

9. The printed document or other device as claimed in claim 6, wherein the raised printed image is a pattern having regions of substantially parallel lines.

10. A printed document or other device comprising a substrate to which printed matter is applied, the substrate having a first side and a second side, a reflective or brightly coloured layer which is printed onto one side of the substrate without embossment, and a raised printed image having regions of substantially parallel lines applied to the reflective or brightly coloured layer by a printing process, at least part of the raised printed image having a height of at least 5 μm and being visible from all angles of the document, the raised printed image being enhanced by the reflective or brightly coloured layer when viewed at different angles and under different lighting conditions.

11. The document of claim 10, wherein the raised image is produced by an intaglio printing process.

12. The document of claim 10, or 11, wherein the substrate is a plastics film capable of use to form a banknote, the reflective or brightly coloured layer being printed directly on the substrate to utilize any reflective effect in the film to intensify the reflective properties of the reflective or brightly coloured layer.

13. The document of claim 10, or 11, wherein the substrate is a plastics film capable of use to form a banknote, the reflective or brightly coloured layer being printed over an opaque ink layer applied to one side of the substrate.

14. The document of claim 10, or 11, wherein the substrate is a paper film having a smooth side to which the reflective or brightly coloured layer is applied.

15. The document of claim 11, wherein the reflective or brightly coloured layer and the opaque layer are applied to the substrate by a Gravure printing process.

16. The document of claim 13, wherein the reflective or brightly coloured layer and the opaque layer is applied by a Gravure printing process.

17. The document of claim 12, wherein the reflective or brightly coloured layer is applied by a Gravure printing process.

18. The document of claim 14, wherein the reflective or brightly coloured layer is applied by a Gravure printing process.

19. The document of claim 10, wherein the reflective or brightly coloured layer is a reflective or brightly colored ink layer.

20. A printed document or other device comprising a plastic substrate to which printed matter is applied, the substrate having a first side and a second side, a reflective or brightly coloured print layer which is printed onto one side of the substrate without embossment wherein the reflective or brightly coloured print layer is a reflective or brightly colored ink layer, and a raised print image applied to the reflective or brightly coloured print layer by a printing process, at least part of the raised print image having a height of at least 5 μm and being visible from all angles of the document, the raised print image being enhanced by the reflective or brightly coloured print layer when viewed at different angles and under different lighting conditions.

21. A printed document or other device comprising a substrate to which printed matter is applied, said substrate having a first side and a second side, a reflective or brightly coloured print layer which is printed onto one side of the substrate without embossment, said reflective or brightly coloured print layer being printed over an opaque ink layer applied to one side of said substrate, and a raised print image printed to said reflective or brightly coloured layer by a printing process, at least part of said raised print image having a height of at least 5 μm and being visible from all angles of the document, said raised print image being enhanced by said reflective or brightly coloured print layer when viewed at different angles and under different lighting conditions.

* * * * *